US008166988B1

(12) United States Patent
Martin

(10) Patent No.: US 8,166,988 B1
(45) Date of Patent: May 1, 2012

(54) MEDICALLY EQUIPPABLE WALKER DEVICE

(76) Inventor: Jody A. Martin, Houston, TX (US)

( * ) Notice: Subject to any disclaimer, the term of this patent is extended or adjusted under 35 U.S.C. 154(b) by 0 days.

(21) Appl. No.: 13/070,603

(22) Filed: Mar. 24, 2011

(51) Int. Cl.
*A61H 3/04* (2006.01)

(52) U.S. Cl. ..... 135/67; 135/66; 482/68

(58) Field of Classification Search ..... 135/66–67, 135/85; 482/66–68; 280/640–648, 47.031, 280/48.021; 248/158
See application file for complete search history.

(56) References Cited

U.S. PATENT DOCUMENTS

| | | | | |
|---|---|---|---|---|
| 4,045,044 | A * | 8/1977 | Bierer | 280/87.021 |
| 4,074,683 | A * | 2/1978 | Di Chiara | 135/67 |
| 4,251,044 | A | 2/1981 | Olson | |
| 4,266,765 | A * | 5/1981 | Sandoval et al. | 482/68 |
| 4,431,206 | A * | 2/1984 | Pryor | 280/304.1 |
| 4,913,393 | A * | 4/1990 | Wood | 248/230.2 |
| 5,476,432 | A | 12/1995 | Dickens | |
| 6,231,016 | B1 * | 5/2001 | Slone | 248/200.1 |
| 6,503,176 | B2 * | 1/2003 | Kuntz | 482/66 |
| 6,672,321 | B2 | 1/2004 | Hamilton | |
| 7,229,084 | B2 * | 6/2007 | McKellar | 280/79.2 |
| 7,243,666 | B2 | 7/2007 | Carroll | |
| 7,726,327 | B2 * | 6/2010 | Battiston | 135/67 |
| 7,896,298 | B2 * | 3/2011 | Meyers et al. | 248/125.8 |
| 7,950,405 | B2 * | 5/2011 | Turner et al. | 135/67 |
| 2008/0135078 | A1 * | 6/2008 | Hsieh | 135/67 |

* cited by examiner

*Primary Examiner* — Winnie Yip

(57) ABSTRACT

The medically equippable walker device provides numerous important features to aid a patient in ambulation and in personal medical equipment carriage. The inverted U's may provide wheels in front and feet in the rear so that a user can easily walk as desired, by tilting the walker off of the feet, and also maintain stability when stopped by allowing the feet to be firmly planted. One side of the device provides two cross rails that are ideal for the sleeves to slideably adjust for desired positioning of a ring and a basket to hold an oxygen tank securely. The second side inverted U holds like upper and lower cross rails with an adjustably positioned rail between. Any number of right angled supports are provided for the carriage of various medical equipment such as IV bags and urine bags, for example.

2 Claims, 5 Drawing Sheets

MEDICALLY EQUIPPABLE WALKER DEVICE

Be it known that I, Jody A. Martin, a citizen of the United States, have invented new and useful improvements in a medically equippable walker device as described in this specification.

BACKGROUND OF THE INVENTION

Walkers are available to those who require mobility yet must be cautious due to potential falls, and also require some measure of support to stand and walk. Those using a walker, though, are often in need of various medical equipments. Such equipment often includes an oxygen tank. Equipment might also include stands for holding urine bags, medication drips, and other such equipment

FIELD OF THE INVENTION

The medically equippable walker device relates to walkers and medical equipment stands.

SUMMARY OF THE INVENTION

The general purpose of the medically equippable walker device, described subsequently in greater detail, is to provide a medically equippable walker device which has many novel features that result in an improved medically equippable walker device which is not anticipated, rendered obvious, suggested, or even implied by prior art, either alone or in combination thereof.

To attain this, the medically equippable walker device provides numerous important features to aid a patient in ambulation and in personal medical equipment carriage. The inverted U's may provide wheels in front and feet in the rear so that a user can easily walk as desired, by tilting the walker off of the feet, and also maintain stability when stopped by allowing the feet to be firmly planted. The inverted U's may also provide only feet. One side of the device provides two cross rails that are ideal for the sleeves to slideably adjust for desired position. The upper cross rail may hold the ring that can be clamped to an oxygen tank via one of the thumb screws. The lower cross rail slideably contains the basket that fully supports an oxygen tank. An oxygen tank can therefore importantly be positioned from front to rear of the inverted U as desired.

The opposite inverted U provided three cross rails, with the middle positioned rail importantly being adjustable for height whereby any desired equipment may be fastened, for example, with a right angled support. The right angled support may be supplied in plurality. Various right angled supports may therefore be used as desired, on any location on the device. As is illustrated, the right angled support is affixed upwardly to the second side second inverted U. The support partially comprises the sleeve and the insert slideably disposed therein. Positioning of the insert is determined and secured by the thumb screw. The 4-pronged hanger represents but one device can is provided with insert attached below. The 4-pronged insert provides for hanging urine bags, IV drips, and other such and desired equipment.

The number of right angled supports is not limited, nor is the number of baskets and rings. The adjustable cross rail thereby provides for further medical equipment carriage beyond that illustrated. The device, therefore, provides an ambulatory patient many options for continued and improved ambulation.

Thus has been broadly outlined the more important features of the improved medically equippable walker device so that the detailed description thereof that follows may be better understood and in order that the present contribution to the art may be better appreciated.

An object of the medically equippable walker device is to provide assistance for a patient to stand and walk.

Another object of the medically equippable walker device is to provide easy patient access and egress.

A further object of the medically equippable walker device is to provide ease of desired movement.

An added object of the medically equippable walker device is to selectively provide stability when stopped.

And, an object of the medically equippable walker device is to provide for carrying oxygen provide for carrying various medical supplies and equipment in addition to carrying oxygen.

These together with additional objects, features and advantages of the improved medically equippable walker device will be readily apparent to those of ordinary skill in the art upon reading the following detailed description of presently preferred, but nonetheless illustrative, embodiments of the improved medically equippable walker device when taken in conjunction with the accompanying drawings.

DETAILED DESCRIPTION OF THE DRAWINGS

With reference now to the drawings, and in particular FIGS. 1 through 5 thereof, the principles and concepts of the medically equippable walker device generally designated by the reference number 10 will be described.

Figure 1:
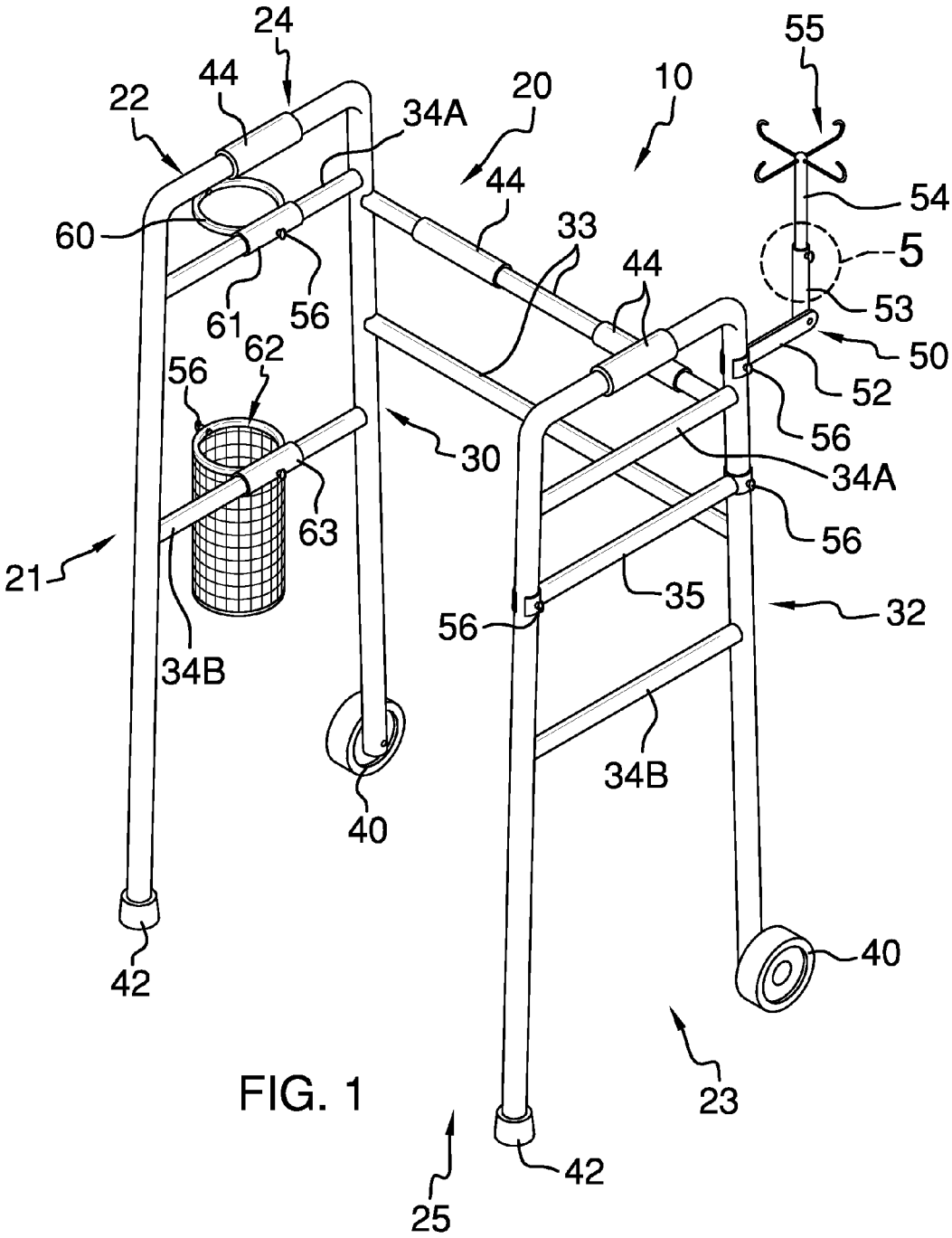
FIG. 1 is a top perspective view.

Referring to FIG. 1, the device 10 partially comprises a front 20 spaced apart from a back 21, a first side 22 spaced apart from a second side 23, and a top 24 spaced apart from a bottom 25. The first inverted U 30 is disposed on the first side 22. The second inverted U 32 is disposed on the second side 23. A wheel 40 is disposed downwardly on the first inverted U 30 front 20. A wheel 40 is disposed downwardly on the second inverted U 32 front 20. A foot 42 is disposed downwardly on the first inverted U 30 back 21. A foot 42 is disposed downwardly on the second inverted U 32 back 21.

Figure 3:
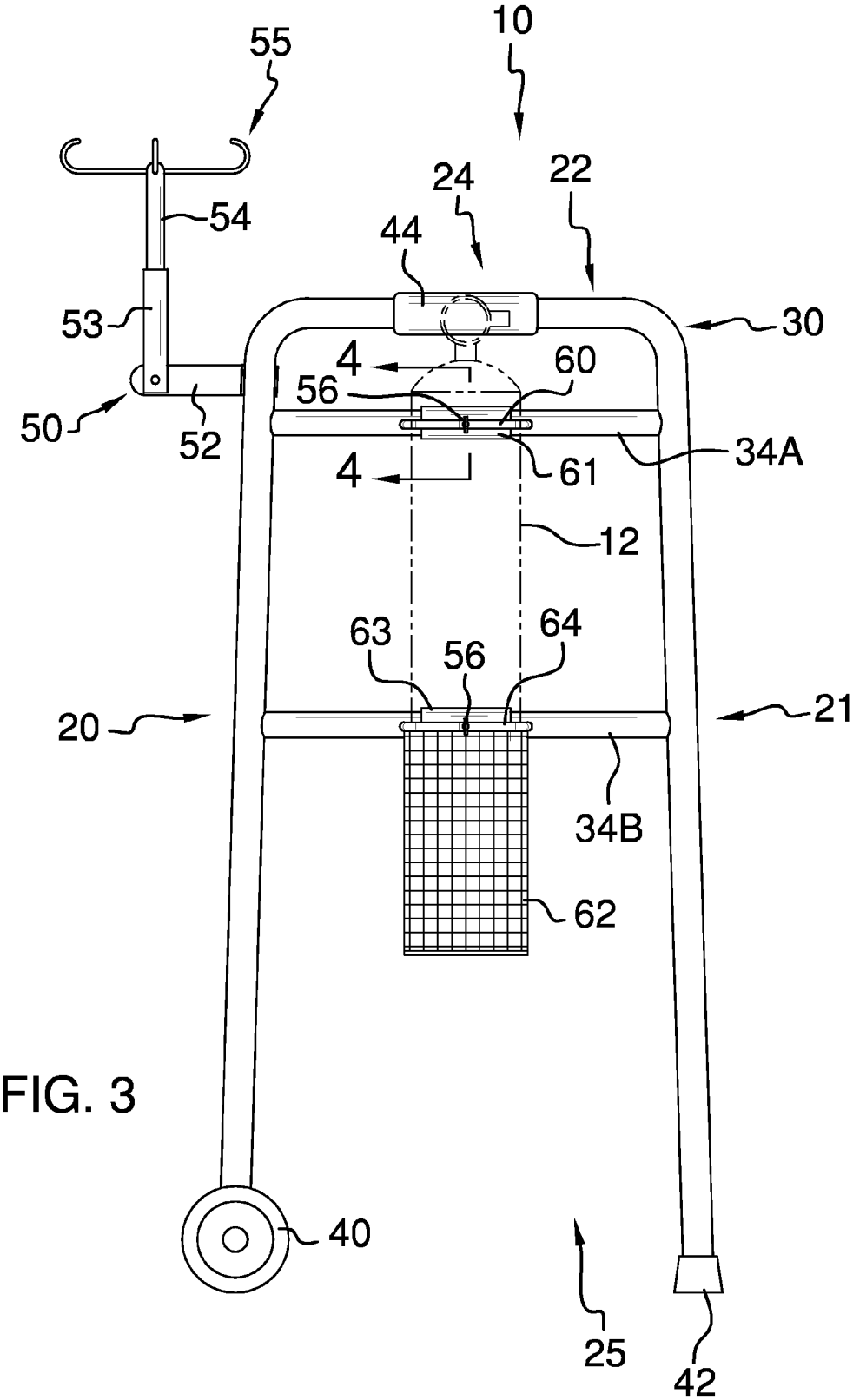
FIG. 3 is a first side elevation view.

Referring to FIG. 3, a lower cross rail 34B is disposed about midway between the top 24 and the bottom 25 of the first inverted U 30. The basket sleeve 63 is slideably and selectively positioned along the first inverted U 30 lower cross rail 34B. The cylindrical basket 62 is extended from the basket sleeve 63. A thumb screw 56 is disposed outwardly and upwardly in the basket 62 and can thereby clamp an oxygen tank 12 or other desired equipment. The upper cross rail 34A is disposed between the lower cross rail 34B and the first inverted U 30 top 24.

Figure 4:
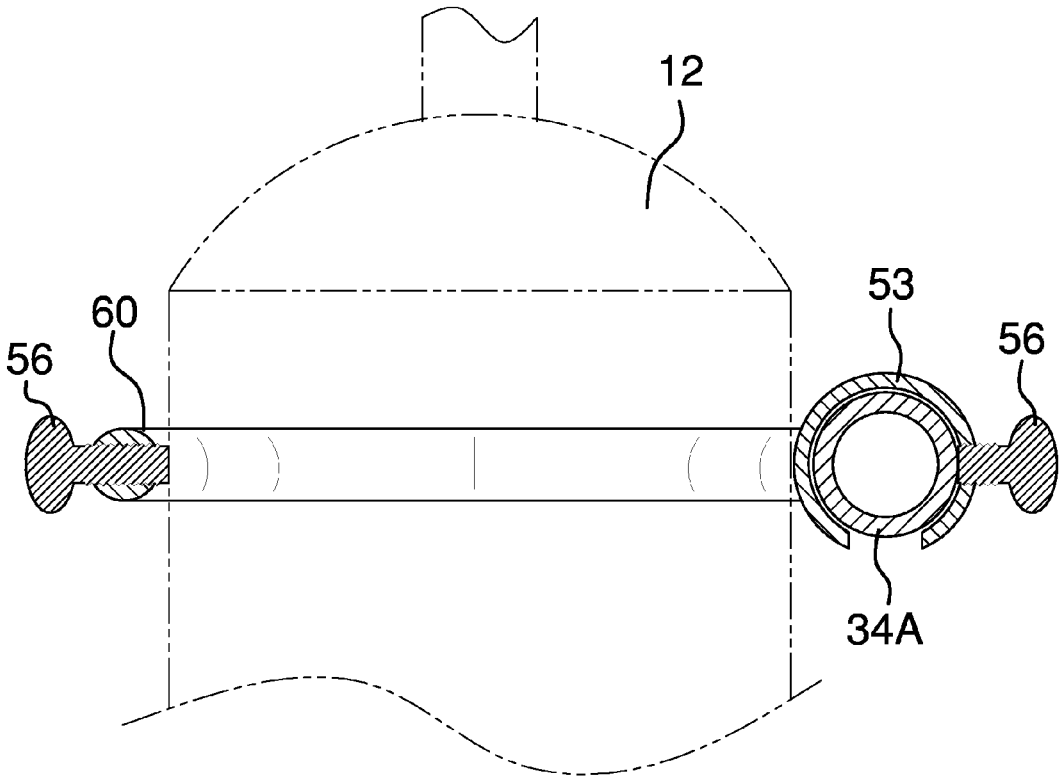
FIG. 4 is a partial cross sectional view of FIG. 3, taken along the line 4-4.

Referring to FIG. 4, the ring sleeve 61 is selectively and slideably positioned along the first inverted U 30 upper cross rail 34A. A thumb screw 56 selectively positions the ring sleeve 61. The ring 60 is extended from the ring sleeve 61. A thumb screw 56 is disposed outwardly in the ring 60 and can be used to clamp an oxygen tank 12 or other equipment.

Figure 2:
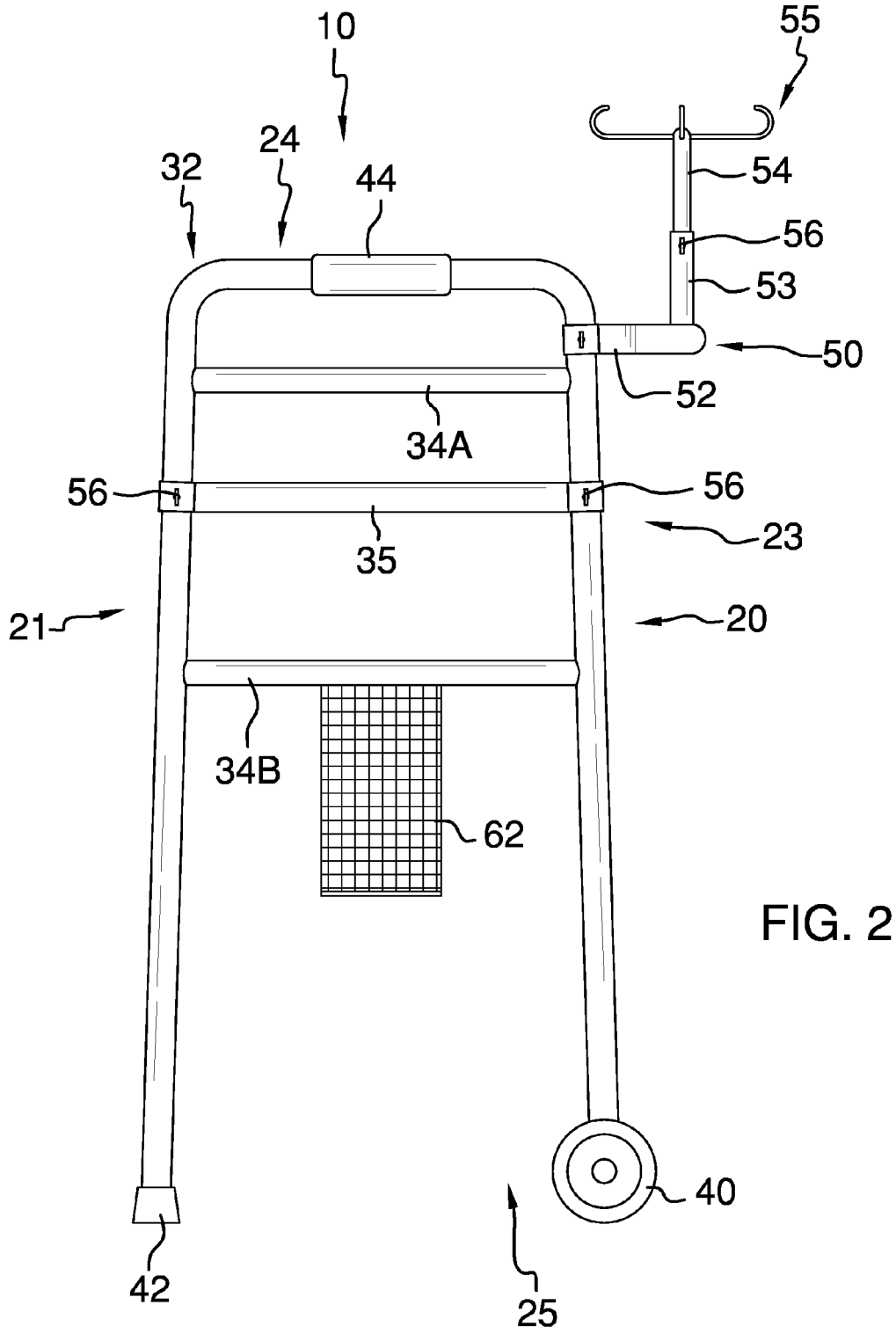
FIG. 2 is a second side elevation view.

Referring to FIG. 2, a lower cross rail 34B is disposed about midway between the top 24 and the bottom 25 of the second inverted U 32. An upper cross rail 34A is disposed between the lower cross rail 34B and the second inverted U 32 top 24. The adjustably positioned cross rail 35 is disposed between the upper cross rail 34A and the lower cross rail 34B of the second inverted U 32.

Referring again to FIG. 1, the pair of spaced apart cross bars 33 connects the front 20 of the first inverted U 30 to the front 20 of the second inverted U 32.

Referring to FIG. 2, at least one right angled support 50 is provided. There is no limit to the number of right angled supports 50. A right angled support 50 is removably fastened to the front 20 of the second inverted U 32. Each right angled support 50 comprises a clamp 52 selectively positioning the right angled support 50 via a thumb screw 56 that locates the clamp 52 as desired. The sleeve 53 is extended at a right angle from the clamp 52.

Figure 5:
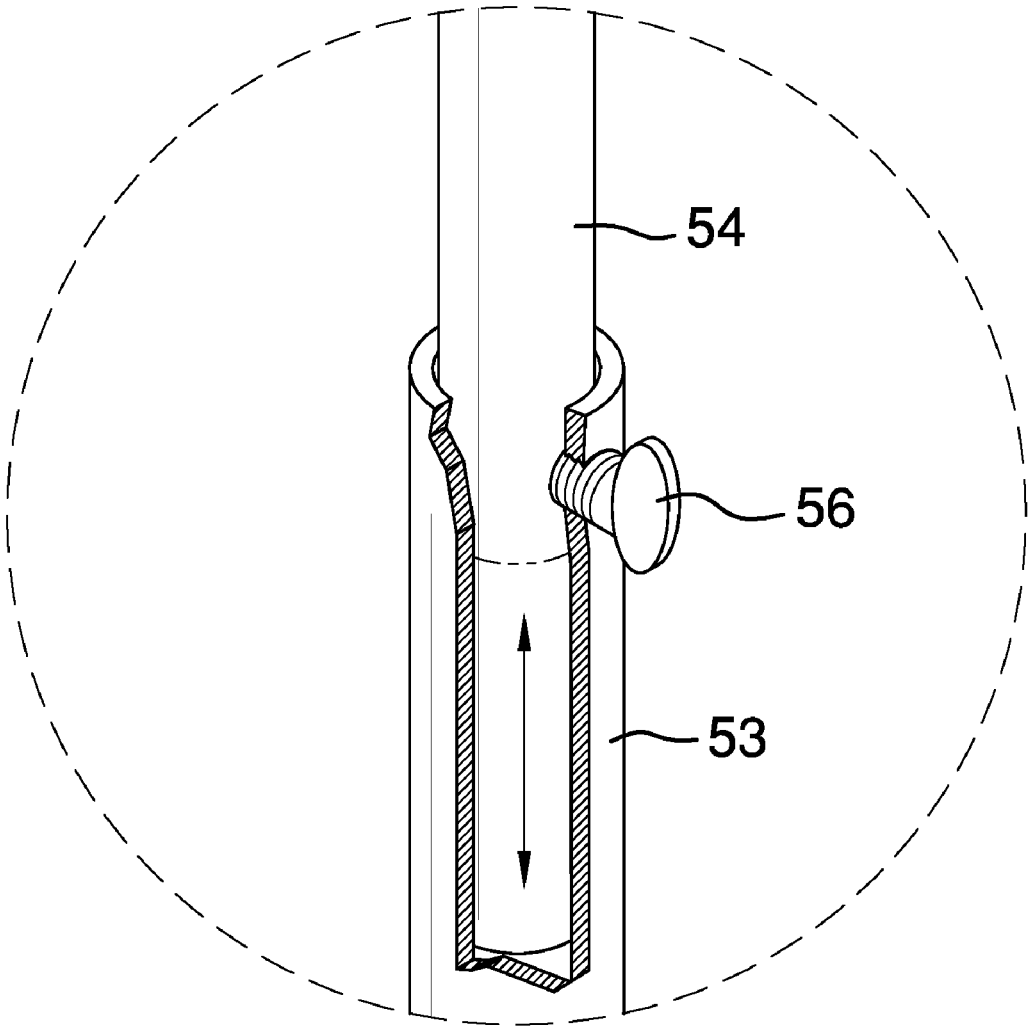
FIG. 5 is a partial blown up partial cross sectional view of FIG. 1

Referring to FIG. 5, the insert 54 is slideably positioned within the sleeve 53 by a thumb screw 56.

Referring again to FIG. 2, the 4-pronged hanger 55 is disposed outwardly on the insert 54.

Referring again to FIG. 1, a pair of spaced apart pads 44 is disposed along the cross bar 33 at the top 24. A pad 44 is disposed upwardly on the first inverted U 30. A pad 44 is disposed upwardly on the second inverted U 32.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the medically equippable walker device may be used.

What is claimed is:

1. A medically equippable walker device comprising, in combination:

a front spaced apart from a back, a first side spaced apart from a second side, and a top spaced apart from a bottom;

a first inverted U disposed on the first side;

a second inverted U disposed on the second side;

a foot disposed downwardly on the first inverted U front;

a foot disposed downwardly on the second inverted U front;

a foot disposed downwardly on the first inverted U back;

a foot disposed downwardly on the second inverted U back;

a lower cross rail disposed about midway between the top and the bottom of the first inverted U;

a basket sleeve slideably and selectively positioned along the first inverted U lower cross rail;

a cylindrical basket extended from the basket sleeve;

a thumb screw disposed outwardly and upwardly in the basket;

an upper cross rail disposed between the lower cross rail and the first inverted U top;

a ring sleeve selectively and slideably positioned along the first inverted U upper cross rail;

a thumb screw selectively positioning the ring sleeve;

a ring extended from the ring sleeve;

a thumb screw disposed outwardly in the ring;

a lower cross rail disposed about midway between the top and the bottom of the second inverted U;

an upper cross rail disposed between the lower cross rail and the second inverted U top;

an adjustably positioned cross rail disposed between the upper cross rail and the lower cross rail of the second inverted U;

a pair of spaced apart cross bars connecting the front of the first inverted U to the front of the second inverted U;

an at least one pad disposed along the cross bar at the top;

a pad disposed upwardly on the first inverted U;

a pad disposed upwardly on the second inverted U;

an at least one right angled support removably fastened to either inverted U, each right angled support comprising:

a clamp selectively positioning each right angled support;

a thumb screw locating the clamp;

a sleeve extended at a right angle from the clamp an insert slideably positioned within the sleeve by a thumb screw;

a 4-pronged hanger disposed outwardly on the insert.

2. A medically equippable walker device comprising, in combination:

a front spaced apart from a back, a first side spaced apart from a second side, and a top spaced apart from a bottom;

a first inverted U disposed on the first side;

a second inverted U disposed on the second side;

a wheel disposed downwardly on the first inverted U front;

a wheel disposed downwardly on the second inverted U front;

a foot disposed downwardly on the first inverted U back;

a foot disposed downwardly on the second inverted U back;

a lower cross rail disposed about midway between the top and the bottom of the first inverted U;

a basket sleeve slideably and selectively positioned along the first inverted U lower cross rail;

a cylindrical basket extended from the basket sleeve;

a thumb screw disposed outwardly and upwardly in the basket;

an upper cross rail disposed between the lower cross rail and the first inverted U top;

a ring sleeve selectively and slideably positioned along the first inverted U upper cross rail;

a thumb screw selectively positioning the ring sleeve;

a ring extended from the ring sleeve;

a thumb screw disposed outwardly in the ring;

a lower cross rail disposed about midway between the top and the bottom of the second inverted U;

an upper cross rail disposed between the lower cross rail and the second inverted U top;

an adjustably positioned cross rail disposed between the upper cross rail and the lower cross rail of the second inverted U;

a pair of spaced apart cross bars connecting the front of the first inverted U to the front of the second inverted U;

an at least one pad disposed along the cross bar at the top;

a pad disposed upwardly on the first inverted U;

a pad disposed upwardly on the second inverted U;

an at least one right angled support removably fastened to either inverted U, each right angled support comprising:

a clamp selectively positioning each right angled support;

a thumb screw locating the clamp;

a sleeve extended at a right angle from the clamp an insert slideably positioned within the sleeve by a thumb screw;

a 4-pronged hanger disposed outwardly on the insert.

* * * * *